US009961996B2

(12) United States Patent
Heath

(10) Patent No.: US 9,961,996 B2
(45) Date of Patent: May 8, 2018

(54) TABLE WITH STORAGE RACK

(71) Applicant: Company of Motion, LLC, Santa Barbara, CA (US)

(72) Inventor: Joel Ward Heath, Santa Barbara, CA (US)

(73) Assignee: Company of Motion, LLC, Santa Barbara, CA (US)

( * ) Notice: Subject to any disclaimer, the term of this patent is extended or adjusted under 35 U.S.C. 154(b) by 0 days. days.

(21) Appl. No.: 15/480,093

(22) Filed: Apr. 5, 2017

(65) Prior Publication Data

US 2017/0290423 A1 Oct. 12, 2017

Related U.S. Application Data

(60) Provisional application No. 62/319,431, filed on Apr. 7, 2016.

(51) Int. Cl.
*A47B 9/00* (2006.01)
*A47B 83/04* (2006.01)
(Continued)

(52) U.S. Cl.
CPC ..... *A47B 83/04* (2013.01); *A47B 9/10* (2013.01); *A47B 9/20* (2013.01); *A47B 13/023* (2013.01);
(Continued)

(58) Field of Classification Search
CPC .. A47B 83/04; A47B 9/00; A47B 9/04; A47B 9/20; A47B 13/023;
(Continued)

(56) References Cited

U.S. PATENT DOCUMENTS 1,844,040 A 2/1932 Lawrenz
3,089,438 A 5/1963 Paradise
(Continued)

FOREIGN PATENT DOCUMENTS

DE 102010056113 6/2002
EP 2570047 A1 3/2013
GB 618221 2/1949

OTHER PUBLICATIONS

Wayback Machine website, Adjustable Height Table Bases Chrome Column, Polished Aluminum Bottom, Kurt Petersen Apr. 18, 2007, 1 p. https://web.archive.org/web/20070418074700/http://www.kpetersen.com/adjustabletablebase2.htm, Copyright 2004-2007 Petersen Furniture, Inc.
(Continued)

*Primary Examiner* — Daniel J Rohrhoff
(74) *Attorney, Agent, or Firm* — Knobbe, Martens, Olson & Bear LLP

(57) ABSTRACT

A table assembly can include a table top, a post assembly coupled at one end to an underside of the table top, and a base assembly operatively coupled to an opposite end of the post assembly and configured to support the table top on a floor surface. The table assembly can include one or more racks disposed above the base assembly and arranged about the post assembly. Each of the one or more racks defines an opening between the post assembly and a cross-bar of the rack configured to receive an elongate platform therethrough for storage. Optionally, the table assembly can have a height adjustment mechanism actuable to adjust the height of the table top above the floor space.

18 Claims, 9 Drawing Sheets

(51) Int. Cl.

| | |
|---|---|
| ***A47B 9/20*** | (2006.01) |
| ***A47B 9/10*** | (2006.01) |
| ***A47B 13/10*** | (2006.01) |
| ***A47B 13/02*** | (2006.01) |

(52) U.S. Cl.
CPC ..... *A47B 13/10* (2013.01); *A47B 2013/024* (2013.01); *A47B 2013/025* (2013.01); *A47B 2200/0022* (2013.01); *A47B 2200/0052* (2013.01); *A47B 2200/0059* (2013.01); *A47B 2200/0086* (2013.01); *A47B 2200/0097* (2013.01)

(58) Field of Classification Search
CPC ..... A47B 2013/024; A47B 2013/025; A47B 2013/026; A47B 2200/0022; A47B 2200/0052; A47B 2200/0086; A47B 2200/0097
See application file for complete search history.

(56) References Cited

U.S. PATENT DOCUMENTS

| | | | | | |
|---|---|---|---|---|---|
| 3,814,362 | A * | 6/1974 | Ritchie | A47B 13/023 | 248/188.3 |
| 5,439,269 | A * | 8/1995 | Cheng | A47C 4/02 | 108/150 |
| 7,469,642 | B1 * | 12/2008 | LeDoux | A47B 9/00 | 108/12 |
| 7,908,977 | B2 | 3/2011 | Zak et al. | | |
| 2003/0167978 | A1 * | 9/2003 | Chuang | A47B 13/023 | 108/34 |
| 2004/0107882 | A1 * | 6/2004 | Zaremski | A47B 9/08 | 108/147.19 |
| 2012/0125237 | A1 | 5/2012 | Heyvaerts | | |
| 2013/0314852 | A1 * | 11/2013 | Kincaid | F16M 11/046 | 361/679.01 |
| 2014/0020606 | A1 * | 1/2014 | Benden | A47B 13/00 | 108/50.14 |
| 2014/0360412 | A1 * | 12/2014 | Zaccai | A47B 83/045 | 108/50.11 |
| 2015/0238014 | A1 * | 8/2015 | Kessler | A47C 7/004 | 297/423.1 |
| 2016/0037907 | A1 * | 2/2016 | Ergun | A47B 9/12 | 108/147 |
| 2017/0042321 | A1 * | 2/2017 | Clause | A47B 13/021 | |

OTHER PUBLICATIONS

Wayfair website, Crystal Bar Table by Langley Street, downloaded Mar. 30, 2016, 3 pp., http://www.wayfair.com/Crystal-Bar-Table-LGLY1370-LGLY1370.html.

* cited by examiner

FIG. 11
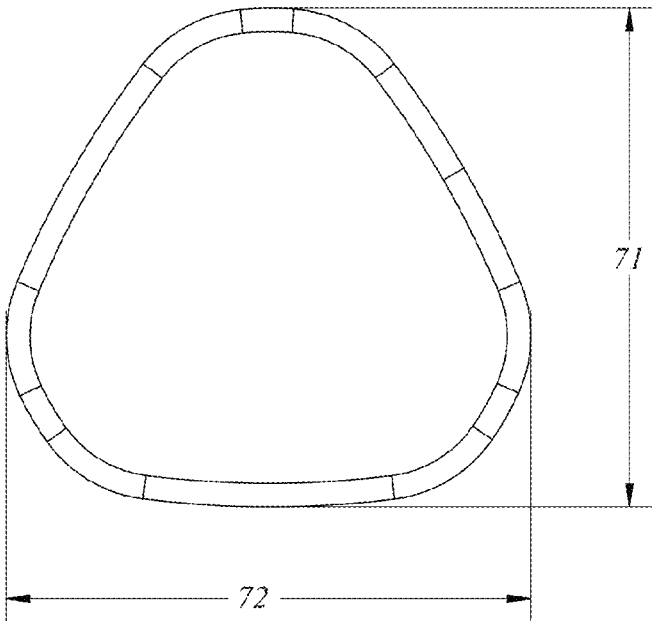
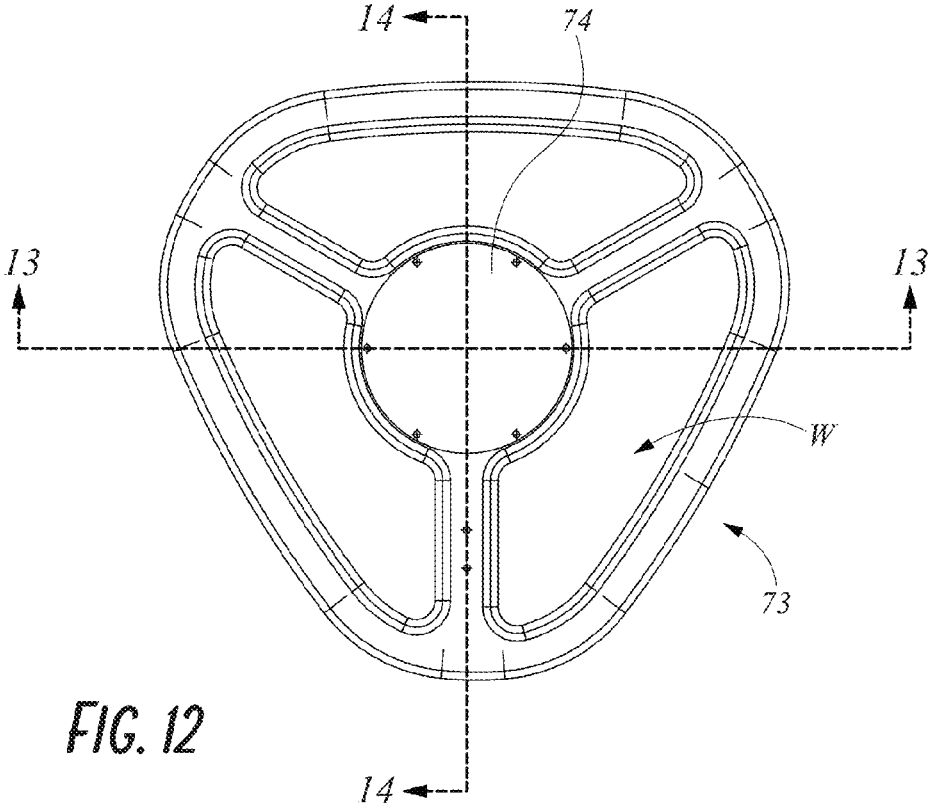
FIG. 12

TABLE WITH STORAGE RACK

CROSS-REFERENCE TO RELATED APPLICATIONS

Any and all applications for which a foreign or domestic priority claim is identified in the Application Data Sheet as filed with the present application are hereby incorporated by reference under 37 CFR 1.57 and should be considered a part of this specification. This application is related to U.S. Non-provisional application Ser. No. 14/554,522, filed Nov. 26, 2014, and U.S. Provisional Application No. 62/277,269, filed Jan. 11, 2016, the entire contents of both of which are hereby incorporated by reference and should be considered a part of this specification.

BACKGROUND

Field

The present invention is directed to tables, and more particularly to a table with a storage rack for use with a work platform on which a user can stand while at the table.

Description of the Related Art

Various sit-to-stand desk designs are available in the market, and are more commonly used to avoid the health impacts of prolonged sitting (e.g., while at work). However, simply spending more time standing up, such as at a sit-to-stand desk, does not solve the problem since the posture is still sedentary, just vertical. Additionally, sedentary standing postures, such as on padded mats, can lead to problems with the user's joints.

Existing sit-to-stand desks suffer from being limited in the functionality they provide to users, which may prevent users from utilizing the sit-to-stand desks as much as possible.

SUMMARY

There is a need for an improved table system that can be used with devices that induce and encourage motion while standing at the table, and that can provide additional functionality to the user when standing at the table (e.g., adjacent the table).

In one aspect, a table is provided that defines a plurality of work stations and includes an integrated rack system with a corresponding plurality of racks for storage of a plurality of work platforms. In another aspect, the table can optionally be a height adjustable table.

In accordance with one aspect, a table assembly is provided. The table assembly comprises a table top, a post assembly coupled at one end to an underside of the table top, and a base assembly operatively coupled to an opposite end of the post assembly and configured to support the table top on a floor surface. The table assembly further comprises one or more racks disposed above the base assembly and arranged about the post assembly, each of the one or more racks defining an opening between the post assembly and a cross-bar of the rack configured to receive an elongate platform therethrough for storage.

In accordance with another aspect, a table assembly is provided. The table assembly comprises a table top, a post assembly coupled at one end to an underside of the table top, the post assembly comprising a height adjustment mechanism actuatable to adjust a height of the table top above a floor surface. The table assembly further comprises a base assembly operatively coupled to an opposite end of the post assembly and configured to support the table top on the floor surface, the base assembly having a plurality of legs spaced circumferentially about the post assembly, adjacent legs defining a floor space therebetween. The table assembly further comprises a rack assembly comprising a plurality of racks disposed above the base assembly and arranged circumferentially about the post assembly, each of the racks defining an opening between the post assembly and a cross-bar of the rack configured to receive an elongate platform therethrough for storage.

In accordance with another aspect, a rack assembly removably coupleable to an existing table is provided. The rack assembly comprises one or more racks coupled to a support member. The support member can be removably coupled with a support post or leg of an existing table. Each of the racks defines an opening between the support post and a cross-bar of the rack configured to receive an elongate platform therethrough for storage. Optionally, the one or more racks can be a plurality of racks arranged circumferentially about the support post.

BRIEF DESCRIPTION OF THE DRAWINGS

Unless otherwise noted, the Figures are drawn to scale.

FIG. 11 is a top planar view of the table top of FIG. 10.

FIG. 12 is a bottom view of the table top of FIG. 10.

DETAILED DESCRIPTION

Figure 1:
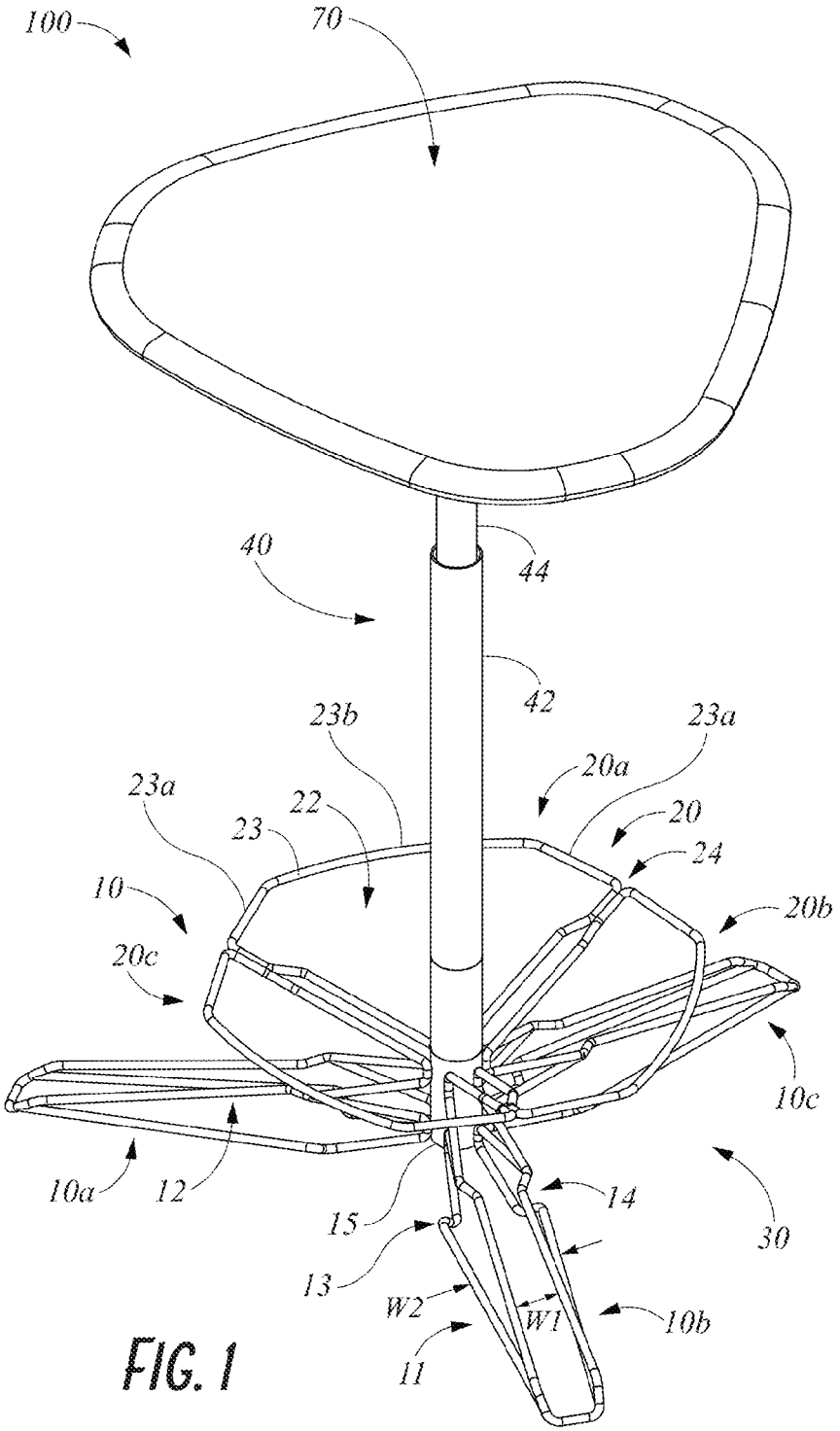
FIG. 1 is a perspective view of one embodiment of a table system.

Disclosed herein are various embodiments of a table system. The table system can be a fixed height table system or a height-adjustable table system. The table system can have a table top, a support post assembly attached to an underside of the table top and a base assembly.

Where the table system is a height-adjustable table system, the support post assembly can include a mechanism for adjusting the height of the table top from the base. In one embodiment, the mechanism can be a hydraulic piston mechanism. A lever or actuator (e.g., located on the underside of the table top) can be actuated (e.g., depressed) to allow the table top to rise (when no weight is placed on the table top) to a desired height, at which point the lever or actuator can be released to lock the height of the table top above the base. To lower the height of the table, the lever or actuator can be actuated (e.g., depressed) while weight is placed on the table top (e.g., while the user bears down on the table top) to move the table top down toward the base until the desired height is achieved, at which point the lever or actuator can be released to lock the height of the table top above the base. In other embodiments, the mechanism can be a pneumatic mechanism. In still another embodiment, the mechanism can be mechanical, such as a ratchet type system (e.g., where the lever or actuator is actuated while the table is lifted by the user to the desired height, and where actuating the lever without supporting the table top allows the table top to drop toward the base).

Optionally, in some embodiments the height of the table top can be adjusted between about 28 inches and about 52 inches from the support surface to accommodate a standing height of users using the table assembly. For example, in some embodiments the height of the table top can be adjusted between about 28 inches and about 40 inches. In other embodiments, the height of the table top can be adjusted between about 40 inches and about 52 inches. However, other dimensions are possible. In still other embodiments, the height of the table top can be adjusted between about 34 inches and about 50 inches. The height adjustment mechanism can optionally be excluded so that the table system with the integrated rack assembly has a fixed height (e.g., at a fixed height of 28 inches, 40 inches, 52 inches, etc.).

The support post assembly can optionally include an anti-rotation mechanism that inhibits (e.g., prevents) rotation of the table top on the support post assembly. The anti-rotation mechanism can optionally be a key and lock system. For example, a first post in the support post assembly can have a spline on its outer surface that interfaces with a slot or groove on an inner surface of a second post that slides over the first post. However, other suitable anti-rotation mechanisms can be used.

The table top can define one or more work areas (e.g., to accommodate one user, two users, three users, etc.). In some embodiments disclosed herein, the table top is generally triangular, defining three work areas (one along each edge of the triangle). However, in other embodiments, the table top can have other shapes and accommodate any number of users (e.g., accommodate a single user, two users, etc.). In one embodiment, the table top can be square to define four work areas (one along each edge of the rectangle). In still other embodiments, the table top can be the size of a conference table (e.g., that accommodates 5, 8, 10, 15, 20 or more people about the table). The table top can have other suitable shapes. Optionally, the table top can have an effective diameter of between about 10 and 50 inches, in one embodiment about 30 inches; however, the table top can have other dimensions.

Advantageously, the table system includes a rack assembly attached to one or both of the base assembly and the support post assembly, where the rack assembly defines one or more (e.g., a plurality of) racks corresponding to and optionally aligned with the corresponding one or more (e.g., a plurality of) work areas on the table top. Each rack is preferably sized to at least partially receive a work platform (described further below) when in a stored position, and to support the work platform off the floor in a substantially fixed position. In one embodiment, in the stored position, the rack holds the work platform so that an end of the work platform that is closer to the ground is laterally closer to the support post and so that an end of the work platform that is farthest from the ground is laterally farther from the support post. In some embodiments, the rack holds the work platform so that the work platform is inclined (angled outwardly) relative to the support post. However, in other embodiments, the rack can hold the work platform in any number of positions or orientations when in the stored position.

In one embodiment, the rack assembly can be removably coupled to an existing table. The rack assembly can have one or more racks coupled to a support member. The support member can be removably coupled with a support post or leg of an existing table. Each of the racks can define an opening between the support post and a cross-bar of the rack configured to receive an elongate platform therethrough for storage. Optionally, the one or more racks can be a plurality of racks arranged circumferentially about the support post.

When the work platform is removed from its corresponding rack, the user can optionally use the rack as a foot rest. In one embodiment, the rack and have a cross bar located between about 2 inches and about 20 inches off the ground, in one embodiment at about 10 inches off the ground, making it easily accessible by the user as a footrest; however, other dimensions are possible. Accordingly, the table system (fixed height or height-adjustable) can define one or more (e.g., a plurality of) work stations, where each work station includes a work area on the table top, a rack disposed under the table top and optionally generally aligned with the work area, and a floor space disposed under the table top and generally aligned with the work area and the rack. The user can place the work platform on the floor space associated with the work station and stand on the work platform while at the work station (e.g., while at work, while at school). In one embodiment, the floor space allows the user to pivot the work platform 360 degrees unimpeded by the base of the sit-to-stand desk or table. Once done using the work platform, the user can pick it up from the floor space and store it on the rack associated with the work station. Advantageously, the rack assembly is dimensioned to allow the user to easily withdraw the work platform from its associated rack, or to insert the work platform on its associated rack, regardless of the height of the table top above the floor.

In one embodiment, the base assembly is defined by an effective diameter greater than an effective diameter of the table top, which can increase the stability of the table assembly. Advantageously, the base assembly can have a profile (e.g., height of the ground) that allows for the user to utilize the work platform without the base assembly interfering with the multi-axial motion of the work platform.

All of the features described above can apply to any of the embodiments described below. Though the embodiments disclosed herein show table assemblies with work stations defined by an equal number of work areas on the table top, equal number of racks and equal number of floor space portions defined by the base assembly, one of skill in the art will understand that other embodiments of table assemblies that fall within the scope of the invention may have unequal numbers of work areas, racks and floor space portions. For example, in one embodiment, the table assembly may have only one rack, or may have two racks, or may have ten racks or more (e.g., where the table top has the size of a conference table), while having the same or different number of work areas on the table top. In one example, the table assembly may have more work areas defined by the table top than the number of racks (e.g., three work areas but only one rack; four work areas, but only two racks, etc.). In another example, the table assembly may have fewer work areas defined on the table top than the number of racks (e.g., three work areas but four racks; four work areas but six racks, etc.). Accordingly, the invention contemplates a table assembly that has any number of work areas defined on the table top and any number of racks (which may be equal, fewer, or more than the number of work areas on the table top). Further, as discussed in the embodiments below, the base assembly may define an equal number or fewer or more floor space portions than the number of work areas on the table top.

FIGS. 1-5 show one embodiment of a table assembly 100. The table assembly 100 includes a base assembly 10, a post assembly 40 and a table top 70. In the illustrated embodiment, the base assembly 10 includes three legs 10*a*, 10*b*, 10*c* coupled to and extending outward from a support post 15 (e.g., support tube). However, in other embodiments, the base assembly 10 can have more than three legs. The base assembly 10 can have an effective outer diameter D of between about 10 inches and about 50 inches, in one embodiment about 38 inches (see FIG. 3). However, in other embodiments, the effective outer diameter D can have other dimensions.

In the illustrated embodiment, the table top 70 is generally triangular. However, in other embodiments, the table top can have other suitable shapes (e.g., square, pentagonal, hexagonal, octagonal, etc.) to accommodate any number of users (e.g., one user, two users, three users, etc.).

In one embodiment, the base assembly 10 can include a rack assembly 20. In another embodiment, the rack assembly 20 is a separate component from the base assembly 10. In the illustrated embodiment, the rack assembly is coupled (e.g., welded) to the support post 15. In the illustrated embodiment, the rack assembly 20 has three racks 20*a*, 20*b*, 20*c*, each sized to store a work platform, such as the work platform disclosed in U.S. application Ser. No. 14/554,522, which is incorporated by reference in its entirety. However, the rack assembly 20 can have fewer (e.g. one rack) or more (e.g., four racks) in other embodiments. The floor space between each two legs 10*a*, 10*b*, 10*c* of the base assembly 10 is advantageously sized to allow the work platform to be used therein (e.g., the distance between each two legs 10*a*, 10*b*, 10*c* is greater than a length of the work platform). In one embodiment, the floor space between each two legs 10*a*, 10*b*, 10*c* of the base assembly 10 allows the user to pivot the work platform 360 degrees unimpeded by the legs 10*a*, 10*b*, 10*c*.

Figure 4:
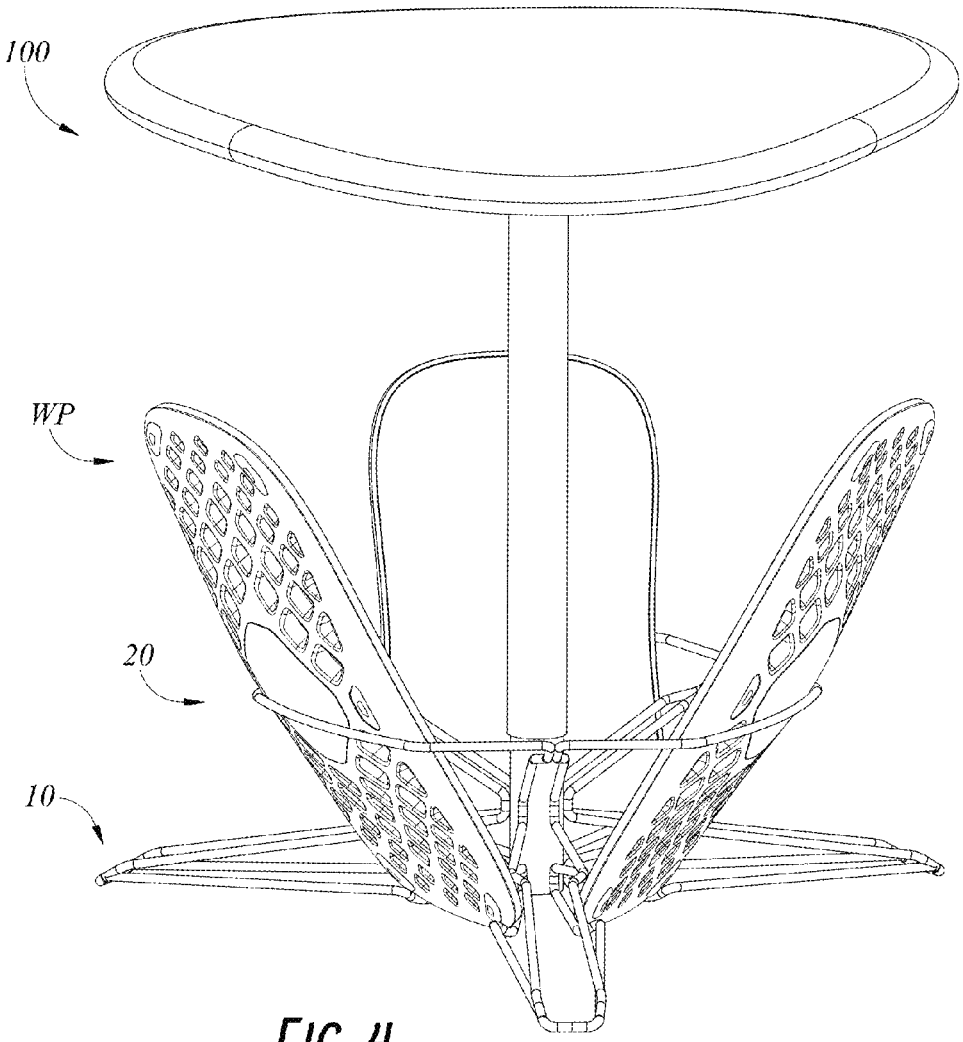
FIG. 4 is a side view of the table system with a plurality of work platforms stored in the racks of the table system.

Each of the racks 20*a*, 20*b*, 20*c* defines an opening 22 that receives its corresponding work platform therethrough so that a cross-bar 23 of the rack 20*a*, 20*b*, 20*c* wraps partially around the bottom and sides of the work platform WP, as shown in FIG. 4. In some embodiments, the rack assembly 20 can be removably coupled to an existing table system, as described above. For example a support post 15 to which the one or more racks 20*a*, 20*b*, 20*c* are coupled can be disposed about a support post or leg of an existing table to integrate the rack assembly 20 into the existing table system.

Each leg 10*a*, 10*b*, 10*c* of the base assembly is defined by a pair of lower bars 11 and a pair of upper bars 12 (the lower bars 11 being farther apart from each other than the upper bars 12), where the upper 12 and lower bars 11 have offset portions (e.g., bent portions) 13, 14 that engage a top (or front) surface F and a bottom (or back) surface of the work platform WP, to advantageously support the work platform WP in generally fixed position when the work platform WP is stored in the rack 20*a*, 20*b*, 20*c*. For each of the legs 10*a*, 10*b*, 10*c*, the pair of upper bars 12 are spaced from each other by a distance W1 that is smaller than a distance W2 by which the pair of lower bars 11 are paced from each other. In the illustrated embodiment, the lower bars taper toward the free end of the leg 10*a*, 10*b*, 10*c* (e.g., the end opposite the base post 15). Additionally, the distance W1 between the upper bars 12 at the bent portion 14 is smaller than the distance W2 between the lower bars 11 at the bent portion 13.

As shown in FIG. 4, the offset portions 13 of two adjacent legs 10*a*, 10*b*, 10*c* support one of the work platforms WP (e.g., contact a bottom surface of the work platform WP) and the offset portions 14 of the two adjacent legs 10*a*, 10*b*, 10*c* contact a top surface of the work platform WP) so that an end of the work platform WP is sandwiched between the offset portion 13, 14 and prevented from shifting out of place. The cross-bar 23 of the rack 20*a*, 20*b*, 20*c* can also be shaped to contact at least a portion of the bottom surface 230 of the work platform WP to inhibit shifting of the work platform WP when stored in the rack 20*a*, 20*b*, 20*c*. For example, the cross-bar can have end portions 23*a* that extend at an angle relative to a center portion 23*b*, where the center portion 23*b* can have a shape (e.g., curvature) generally corresponding to a shape (e.g., curvature) of the bottom surface of the work platform WP.

As shown in FIG. 1, the base assembly 10 (e.g., legs 10*a*, 10*b*, 10*c*) and rack assembly 20 can be defined by the same bent bar structure 30 (e.g., a unitary, monolithic or single piece structure), and can be welded to the support post 15 (e.g., welded to a bottom portion of the support post 15 that is fixed and does not move as the height of the table system is adjusted). In one embodiment, at least a portion of two adjacent legs of the one or more legs 10*a*, 10*b*, 10*c* and one of the racks 20*a*, 20*b*, 20*c* can be defined by a single continuous (monolithic) bent rod. As shown in FIG. 1, the racks 20*a*, 20*b*, 20*c* of the rack assembly can be welded to each other at junctions 24 for increased rigidity and stability. In the illustrated embodiment, the three racks 20*a*, 20*b*, 20*c* of the rack assembly 20 form a continuous shape about the support post 15.

With continued reference to FIGS. 1-5, the post assembly 40 can optionally be a height adjustment assembly 40 include an outer post 42, and inner post 44 that can move axially (e.g., in a telescoping manner) relative to the outer post 42 and a support plate 46 attached to a proximal end of the inner post 44. The support plate 46 can be fastened to the underside of the table top 70 to couple the height adjustment assembly 40 to the table top 70. The height adjustment assembly 40 can be a hydraulic system operable to move the inner post 44 relative to the outer post 42. In another embodiment, the height adjustment assembly 40 can be a pneumatic system operable to move the inner post 44 relative to the outer post 42. In still another embodiment, the height adjustment system 40 can be a mechanical (e.g., ratchet) system operable to move the inner post 44 relative to the outer post 42. In still another embodiment, the height adjustment system 40 can be electric system (e.g., include an electric motor operable to move the inner post 44 relative to the outer post 42).

Figure 5:
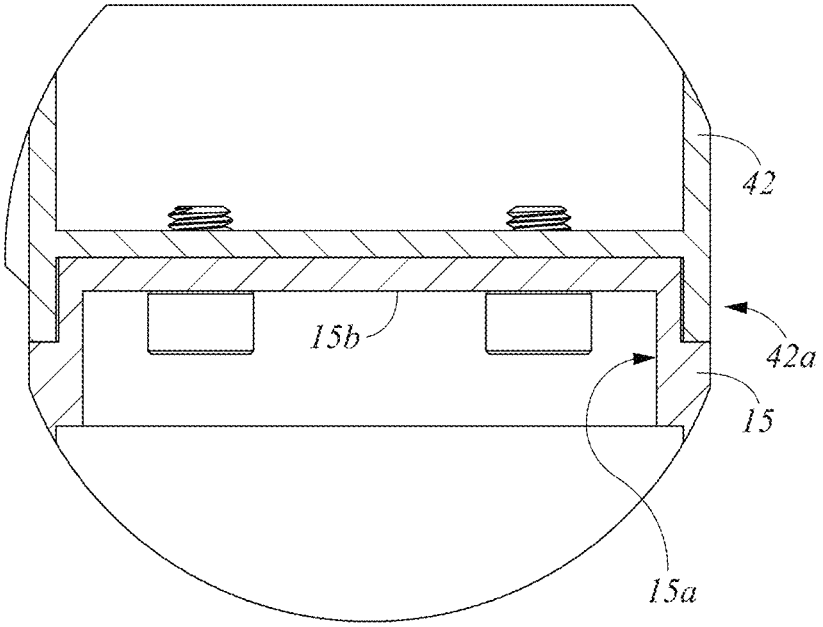
FIG. 5 is a partial sectional view of a portion of the table system of FIG. 1.
Figure 6:
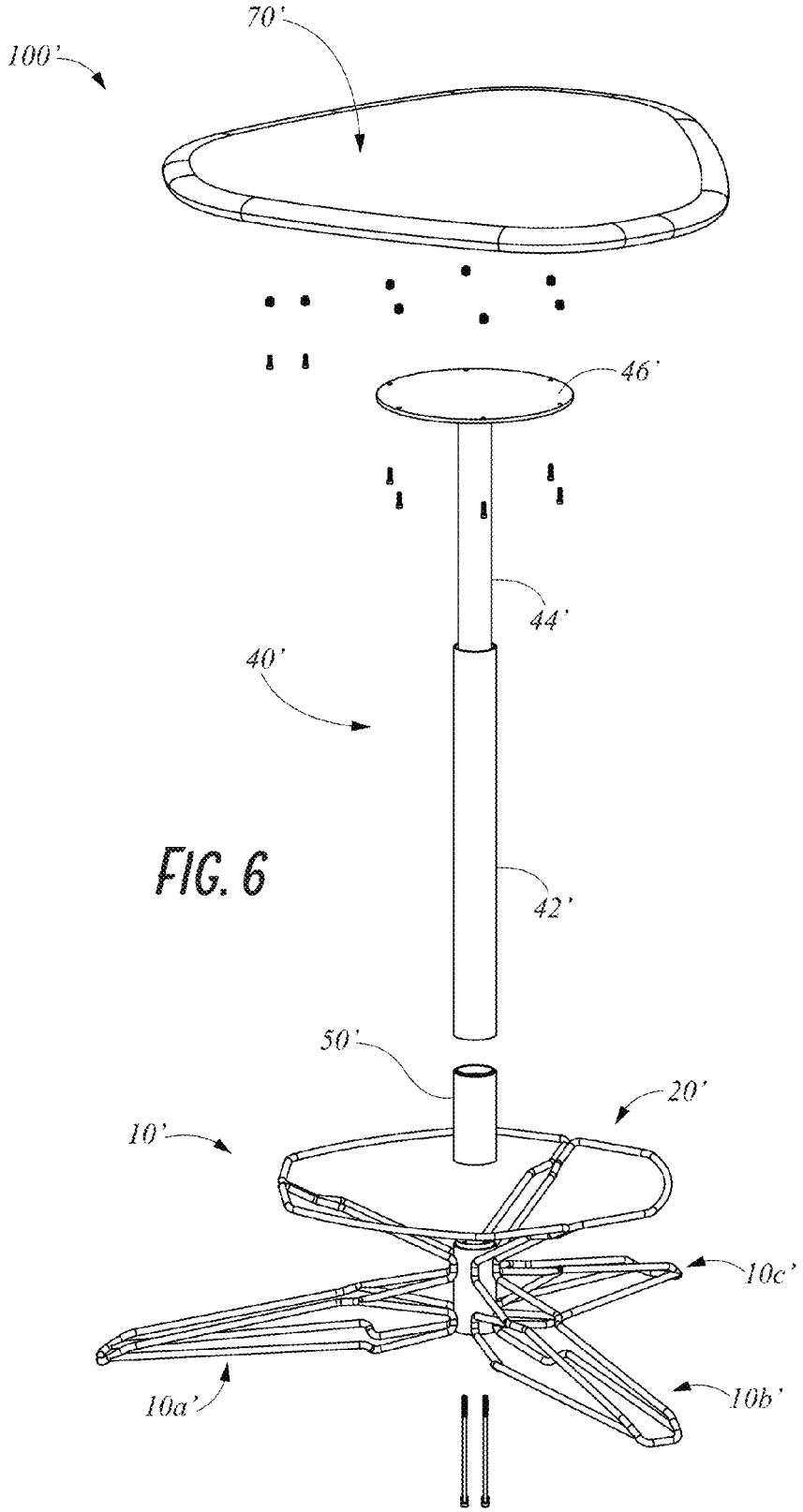
FIG. 6 is a perspective exploded view of another embodiment of a table system.
Figure 7:
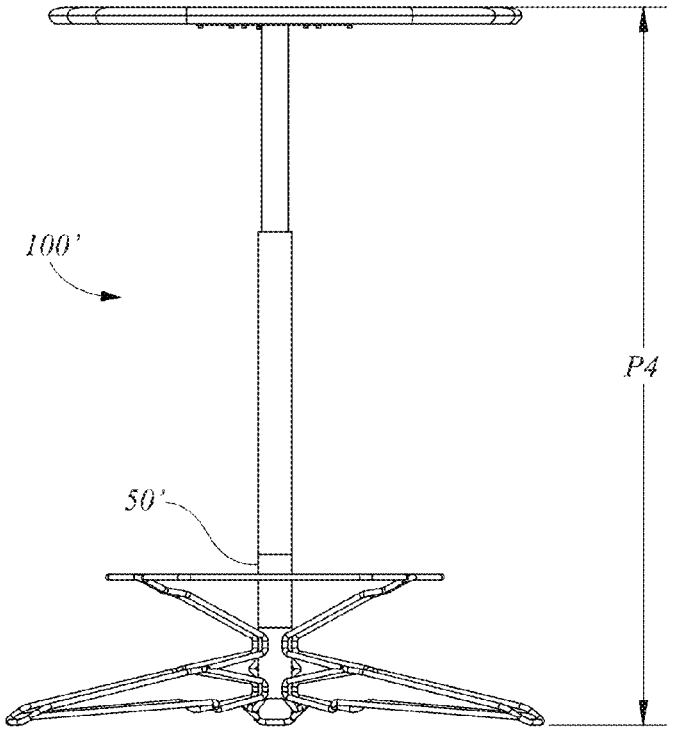
FIG. 7 is a side view of the table system of FIG. 6 in one position.
Figure 8:
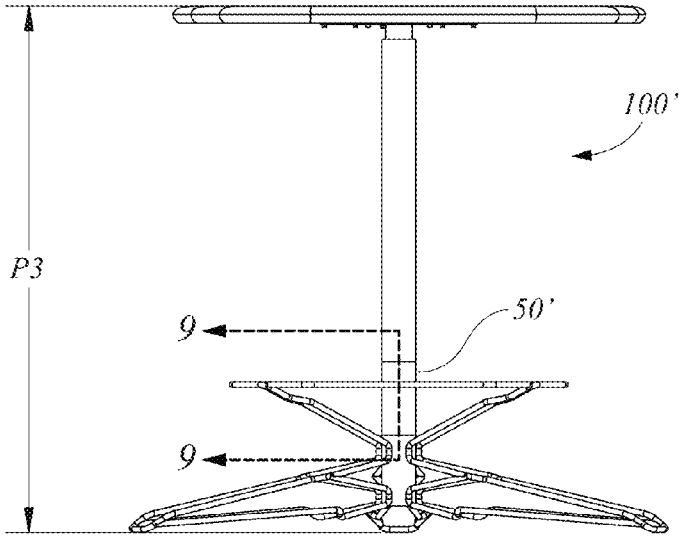
FIG. 8 is a side view of the table system of FIG. 6 in another position.
Figure 9:
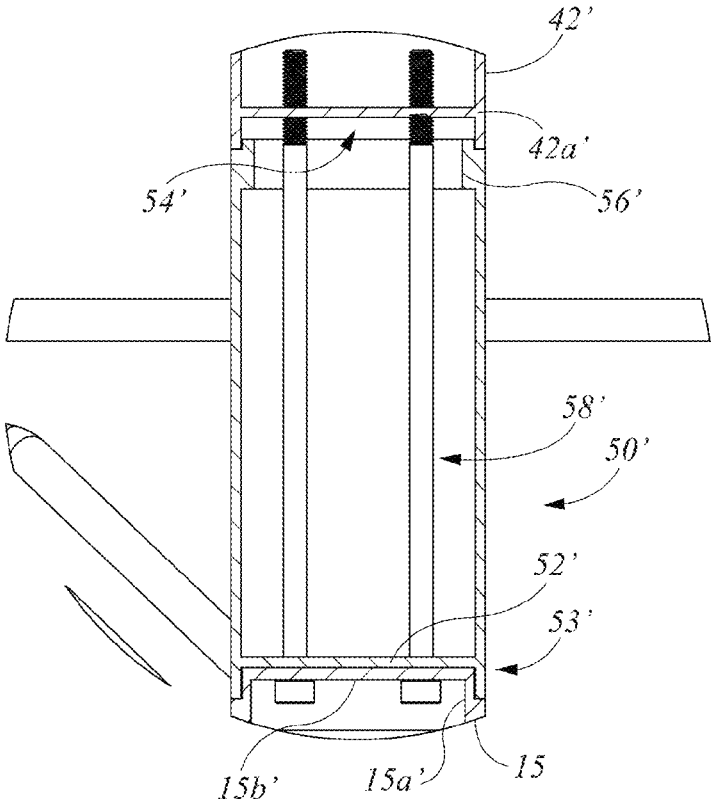
FIG. 9 is a partial sectional view of a portion of the table system of FIG. 6.
Figure 10:
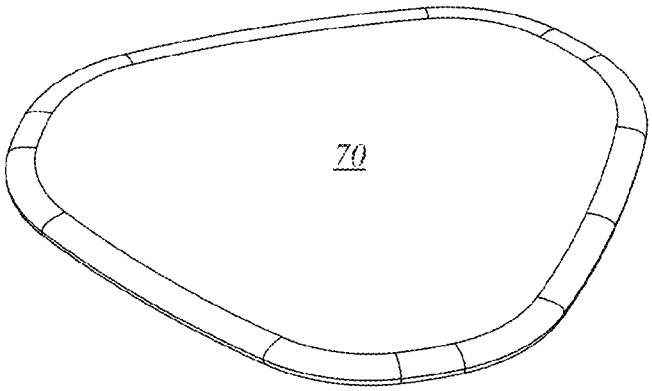
FIG. 10 is a perspective view of one embodiment of a table top of a table system.
Figure 13:
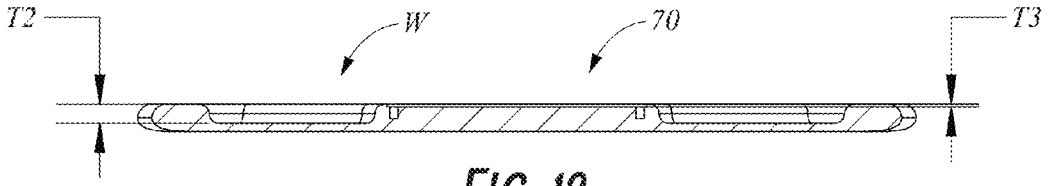
FIG. 13 is a cross-sectional view of the table top of FIG. 1 along line A-A.
Figure 14:
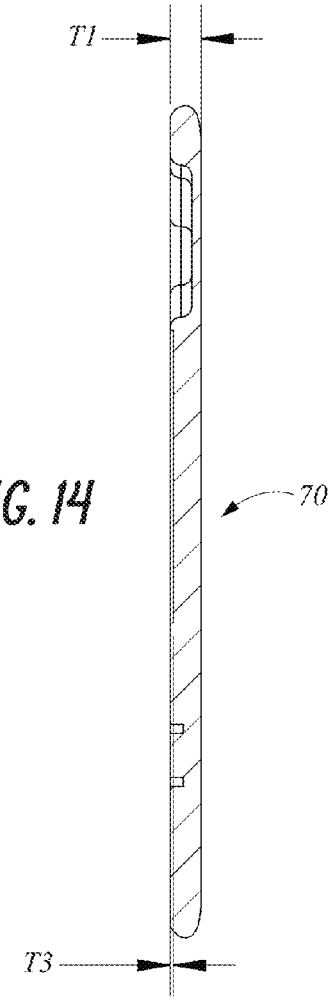
FIG. 14 is a cross-sectional view of the table top of FIG. 11 along line B-B.

As best shown in FIG. 5, the outer post 42 can be fastened to the support post 15 (e.g., by one or more screws or bolts). In one embodiment, the outer post 42 can have a circumferential extension or overhang 42*a* that extends over a raised shoulder 15*a* of the support post 15, advantageously providing further rigidity to the connection between the outer post 42 and the support post 15.

Figure 2:
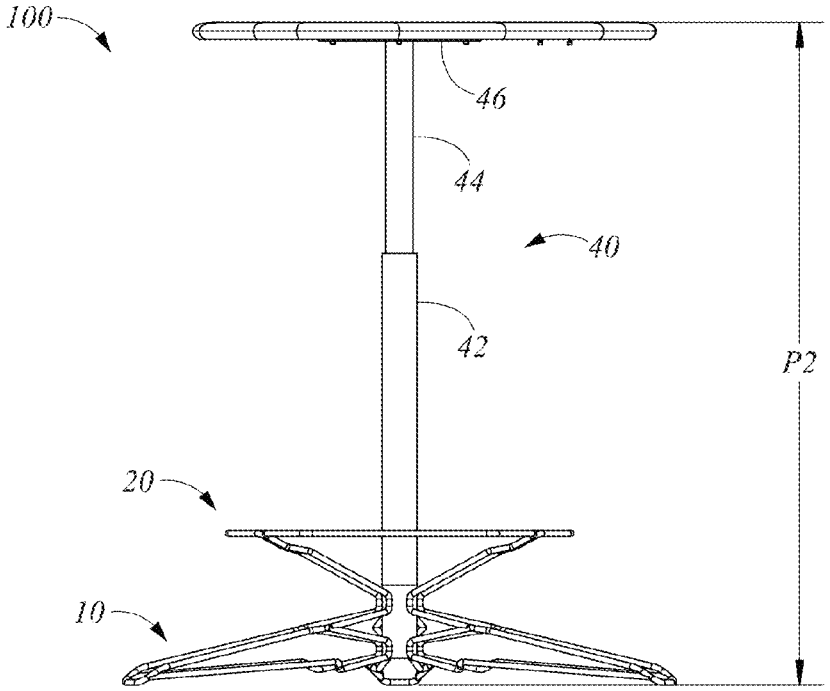
FIG. 2 is a side view of the table system of FIG. 1 in one position.
Figure 3:
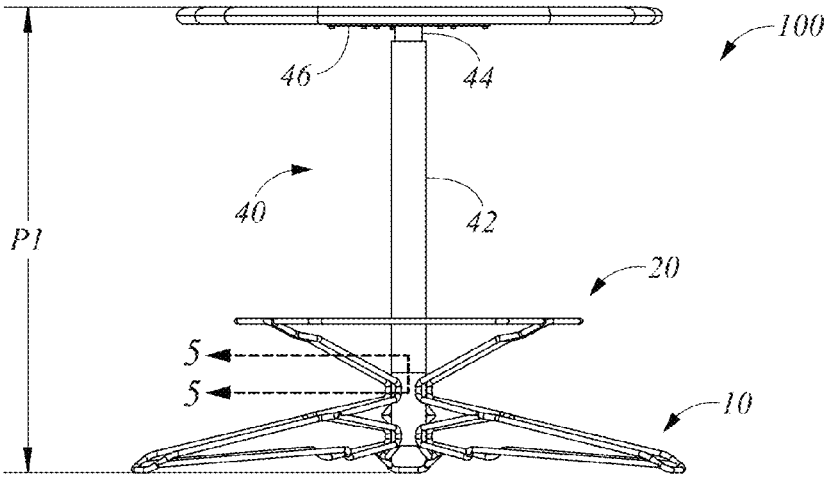
FIG. 3 is a side view of the table system of FIG. 1 in another position.

The height adjustment assembly 40 allows the height of the table 100 to be adjusted between a position P1 (see FIG. 3) and a relatively higher position P2 (see FIG. 2). In one embodiment, the height adjustment assembly 40 provides for continuous height adjustment, allowing the user to adjust the height of the table 100 to their desired height. In another embodiment, the height adjustment assembly 40 provides for incremental height adjustment to a plurality of defined height locations, allowing the user to adjust the height of the table 100 to a plurality of discrete heights. In another embodiment, the height adjustment assembly 40 can be excluded so that the table assembly 100 has a fixed height.

FIGS. 6-9 shows an embodiment of a height adjustable table assembly with an integrated rack system 100' that is similar to the assembly 100 in FIGS. 1-5, except as described below. The assembly 100' is constructed in a similar manner to the assembly 100 shown in FIGS. 1-5, except as noted below. Therefore, the references numerals used to designate the various features of the assembly 100' are identical to those used for identifying the corresponding features of the assembly 100 in FIGS. 1-5, except that an "'" has been added to the reference numerals.

The table assembly 100' includes an extension 50' between the support post 15' and the outer post 42' of the height adjustment assembly 40'. In one embodiment, the extension 50' can have a base 52' that can contact a surface 15*b'* of the support post 15' and a circumferential extension or overhang 53' that extends over a raised shoulder 15*a'* of the support post 15', advantageously providing further rigidity to the connection between the extension 50' and the support post 15'. The extension 50' can have an opening 54' at the proximal end and a shoulder 56' over which the circumferential extension or overhang 42*a'* of the outer post 42' extends. One or more fasteners 58' couple the extension 50' to the support post 15' and the outer post 42'.

The extension 50' provides the table assembly 100' with additional height relative to the table assembly 100. The height adjustment assembly 40' and extension 50' allows the adjustment of the height of the table assembly 100' between a position P3 (see FIG. 8) and a relatively higher position P4 (see FIG. 7). The position P3 is higher than the position P1 and the position P4 is higher than the position P2. In one embodiment, the extension 50' provides the table assembly 100' with an additional height of approximately six inches. However, in other embodiments, the extension 50' can provide the table assembly 100' with an additional height of other magnitudes (e.g., greater than six inches, greater than 1 foot, less than six inches, etc.).

In another embodiment, the table assembly 100, 100' can exclude the height adjustment assembly 40, 40' and instead a rigid post can interconnect the table top 70 and the base assembly 10, with or without the extension 50'. Therefore, in some embodiments, the table assembly 100, 100' has a fixed height.

FIGS. 11-14 show one embodiment of a table top 70. In the illustrated embodiment, the table top 70 has a generally triangular shape with a length 71 and a width 72. However, in other embodiments, the table top 70 can have other suitable shapes, such as square, rectangular, pentagonal, hexagonal, octagonal, etc. The underside 73 of the table top 70 can have a support surface 74 that can couple to (e.g., with fasteners such as screws, bolts, etc.) and contact the support plate 46 of the height adjustment assembly 40. The support surface 74 can in one embodiment be circular, though in other embodiments it can have other suitable shapes. The table top 70 can have a thickness T1, can have one more wells W in the underside 73 with a depth T2. The support surface 74 can extend a distance T3 from the underside of the edge of the table top 70.

Though the figures show a table assembly 100 with multiple storage racks, one of skill in the art will recognize that the table assembly can have a single storage rack. Though the figures show a table assembly 100 with a single post assembly 40, one of skill in the art will recognize that the table assembly can have multiple post assemblies 40, each with their base assembly and rack assembly. For example, where the table assembly 100 has a larger (e.g., longer) table top, such as for use in a conference room, there may be multiple post assemblies 40 supporting the table top, each post assembly having its associated base assembly and rack assembly. All of these variations are contemplated by the invention.

While certain embodiments of the inventions have been described, these embodiments have been presented by way of example only, and are not intended to limit the scope of the disclosure. Indeed, the novel methods and systems described herein may be embodied in a variety of other forms. Furthermore, various omissions, substitutions and changes in the systems and methods described herein may be made without departing from the spirit of the disclosure. For example, one portion of one of the embodiments described herein for a fixed height or height-adjustable table system can be substituted for another portion in another embodiment described herein for a fixed height or height-adjustable table system. The accompanying claims and their equivalents are intended to cover such forms or modifications as would fall within the scope and spirit of the disclosure. Accordingly, the scope of the present inventions is defined only by reference to the appended claims.

Features, materials, characteristics, or groups described in conjunction with a particular aspect, embodiment, or example are to be understood to be applicable to any other aspect, embodiment or example described in this section or elsewhere in this specification unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The protection is not restricted to the details of any foregoing embodiments. The protection extends to any novel one, or any novel combination, of the features disclosed in this specification (including any accompanying claims, abstract and drawings), or to any novel one, or any novel combination, of the steps of any method or process so disclosed.

Furthermore, certain features that are described in this disclosure in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations, one or more features from a claimed combination can, in some cases, be excised from the combination, and the combination may be claimed as a subcombination or variation of a sub combination.

Moreover, while operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Further, the operations may be rearranged or reordered in other implementations. Those skilled in the art will appreciate that in some embodiments, the actual steps taken in the processes illustrated and/or disclosed may differ from those shown in the figures. Depending on the embodiment, certain of the steps described above may be removed, others may be added. Furthermore, the features and attributes of the specific embodiments disclosed above may be combined in different ways to form additional embodiments, all of which fall within the scope of the present disclosure. Also, the separation of various system components in the implementations described above should not be understood as requiring such separation in all implementations, and it should be understood that the described components and systems can generally be integrated together in a single product or packaged into multiple products.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Conditional language, such as "can," "could," "might," or "may," unless specifically stated otherwise, or otherwise understood within the context as used, is generally intended to convey that certain embodiments include, while other embodiments do not include, certain features, elements, and/or steps. Thus, such conditional language is not generally intended to imply that features, elements, and/or steps are in any way required for one or more embodiments or that one or more embodiments necessarily include logic for deciding, with or without user input or prompting, whether these features, elements, and/or steps are included or are to be performed in any particular embodiment.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, or 0.1 degree.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

What is claimed is:

1. A table assembly, comprising:

a table top;

a post assembly coupled at one end to an underside of the table top;

a base assembly operatively coupled to an opposite end of the post assembly and configured to support the table top on a floor surface, the base assembly comprising a plurality of legs spaced circumferentially about the post assembly, adjacent legs defining a floor space therebetween; and one or more racks disposed above the base assembly and arranged about the post assembly, each of the one or more racks defining an opening between the post assembly and a cross-bar of the rack configured to receive an elongate platform therethrough for storage, wherein at least a portion of two adjacent legs and one of the one or more racks are defined by a continuous rod.

2. The assembly of claim 1, wherein the one or more racks is a plurality of racks.

3. The assembly of claim 1, wherein each of the one or more racks is disposed at least partially above the floor space defined between adjacent legs.

4. The assembly of claim 1, wherein each of the plurality of legs are configured to support an end of the elongate platform when stored in the rack.

5. The assembly of claim 4, wherein each of the plurality of legs has bent portions configured to engage a bottom surface and a top surface of the elongate platform to inhibit dislodgement of the elongate platform when stored in the rack.

6. The assembly of claim 4, wherein each of the legs is defined by a pair of lower bars and a pair of upper bars, the pair of lower bars spaced further apart than the pair of upper bars.

7. The assembly of claim 1, wherein the base assembly and the one or more racks are an integral unit.

8. The assembly of claim 1, further comprising an extension coupleable between the post assembly and the base assembly to increase a height of the table top above the floor surface.

9. The assembly of claim 1, wherein the post assembly comprises an inner post and an outer post movable relative to each other in a telescoping manner to adjust a height of the table top above the floor surface.

10. The assembly of claim 9, wherein the post assembly comprises a height adjustment mechanism actuatable to adjust the height of the table top above the floor space.

11. The assembly of claim 1, wherein the cross-bar of the rack defines a footrest.

12. A table assembly, comprising:

a table top;

a post assembly coupled at one end to an underside of the table top, the post assembly comprising a height adjustment mechanism actuatable to adjust a height of the table top above a floor surface;

a base assembly operatively coupled to an opposite end of the post assembly and configured to support the table top on the floor surface, the base assembly having a plurality of legs spaced circumferentially about the post assembly, adjacent legs defining a floor space therebetween; and a rack assembly comprising a plurality of racks disposed above the base assembly and arranged circumferentially about the post assembly, each of the racks defining an opening between the post assembly and a cross-bar of the rack configured to receive an elongate platform therethrough for storage, wherein each of the plurality of legs has bent portions configured to engage a bottom surface and a top surface of the elongate platform to inhibit dislodgement of the elongate platform when stored in the rack.

13. The assembly of claim 12, wherein each rack is disposed at least partially above the floor space defined between adjacent legs.

14. The assembly of claim 12, wherein the base assembly and the rack assembly are an integral unit.

15. The assembly of claim 12, further comprising an extension coupleable between the post assembly and the base assembly to increase a height of the table top above the floor surface.

16. The assembly of claim 12, wherein the post assembly comprises an inner post and an outer post movable relative to each other in a telescoping manner to adjust a height of the table top above the floor surface.

17. A table assembly, comprising:

a table top;

a post assembly coupled at one end to an underside of the table top, the post assembly comprising a height adjustment mechanism actuatable to adjust a height of the table top above a floor surface;

a base assembly operatively coupled to an opposite end of the post assembly and configured to support the table top on the floor surface, the base assembly having a plurality of legs spaced circumferentially about the post assembly, adjacent legs defining a floor space therebetween, wherein each of the legs is defined by a pair of lower bars and a pair of upper bars, the pair of lower bars spaced further apart than the pair of upper bars; and a rack assembly comprising a plurality of racks disposed above the base assembly and arranged circumferentially about the post assembly, each of the racks defining an opening between the post assembly and a cross-bar of the rack configured to receive an elongate platform therethrough for storage.

18. In combination with an existing table, a rack assembly comprising one or more racks arranged about a support member that is removably coupleable to a support post or leg of the existing table, wherein the existing table comprises a plurality of legs spaced circumferentially about a post assembly, adjacent legs defining a floor space therebetween, wherein each of the one or more racks is disposed at least partially above the floor space defined between adjacent legs, wherein at least a portion of two adjacent legs and one of the one or more racks are defined by a continuous rod, and wherein each of the one or more racks define an opening between the support member and a cross-bar of the rack configured to receive an elongate platform therethrough for storage.

* * * * *